US009613513B2

(12) United States Patent
Alpert

(10) Patent No.: US 9,613,513 B2
(45) Date of Patent: Apr. 4, 2017

(54) WINDOW BLIND PULL-STRING ALARM APPARATUS, SYSTEMS, AND METHODS OF MAKING AND USING THE SAME

(71) Applicant: Mark D. Alpert, Lake in the Hills, IL (US)

(72) Inventor: Mark D. Alpert, Lake in the Hills, IL (US)

( * ) Notice: Subject to any disclaimer, the term of this patent is extended or adjusted under 35 U.S.C. 154(b) by 0 days.

(21) Appl. No.: 14/598,850

(22) Filed: Jan. 16, 2015

(65) Prior Publication Data

US 2017/0018161 A1 Jan. 19, 2017

Related U.S. Application Data

(60) Provisional application No. 61/975,359, filed on Apr. 4, 2014.

(51) Int. Cl.

| | |
|---|---|
| ***G08B 21/00*** | (2006.01) |
| ***G08B 21/02*** | (2006.01) |
| ***E06B 9/326*** | (2006.01) |
| ***E06B 9/24*** | (2006.01) |
| ***E06B 9/38*** | (2006.01) |
| ***G08B 21/18*** | (2006.01) |

(52) U.S. Cl.

CPC ..... *G08B 21/02* (2013.01); *E06B 9/24* (2013.01); *E06B 9/326* (2013.01); *E06B 9/38* (2013.01); *G08B 21/182* (2013.01); *E06B 2009/3265* (2013.01)

(58) Field of Classification Search

CPC .. G08B 21/02; G08B 21/0216; G08B 21/025; G08B 21/182; E06B 9/24; E06B 9/326; E06B 2009/3265; Y10T 24/2708; Y10T 24/32; Y10T 24/38; Y10T 24/45461; A47H 11/02; A47H 2201/01; A47H 2201/02; F16G 11/10

USPC ..... 340/545.8, 545.7, 573.1, 665, 666, 668, 340/57; 73/760, 761, 862.381, 862.391; 160/168.2, 320; 116/67 R, 200

See application file for complete search history.

(56) References Cited

U.S. PATENT DOCUMENTS 4,281,320 A * 7/1981 Rosenberg ..... G08B 13/126 109/41
4,792,798 A * 12/1988 Wilowski ..... A61F 4/00 340/286.07
5,552,769 A * 9/1996 Riordan ..... G08B 13/126 160/10

(Continued)

OTHER PUBLICATIONS

International Search Report and Written Opinion, PCT Pat. App. No. PCT/US2015/024521.

*Primary Examiner* — George Bugg
*Assistant Examiner* — Anthony D Afrifa-Kyei
(74) *Attorney, Agent, or Firm* — Scherrer Patent & Trademark Law, P.C.; Stephen T. Scherrer; Monique A. Morneault

(57) ABSTRACT

The present invention relates to an alarm for detecting and alerting a person of an event where a device is pulled on for an extended period of time. Specifically, the present invention relates to an alarm implemented on a pull-string. Even more specifically, the present invention relates to an apparatus, system, and method of using the same that alerts a person when something becomes tangled or is otherwise caught up in the pull-string of window blinds, shades, or other light blocking devices.

20 Claims, 10 Drawing Sheets

(56) References Cited

U.S. PATENT DOCUMENTS

2007/0052538 A1* 3/2007 Sakai ..... G08B 13/08
340/545.1

* cited by examiner

WINDOW BLIND PULL-STRING ALARM APPARATUS, SYSTEMS, AND METHODS OF MAKING AND USING THE SAME

TECHNICAL FIELD

The present invention relates to an alarm for detecting and alerting a person of an event where a device is pulled for an extended period of time. Specifically, the present invention relates to an alarm implemented on a pull-string for window blinds. Even more specifically, the present invention relates to an apparatus, system, and method of using the same that alerts a person when something becomes tangled or is otherwise caught up in the pull-string of window blinds, shades, or other light blocking devices.

BACKGROUND

It is, of course, generally known to have drapery, blinds, shutters, or the like in one's home, business, health club, store, or other similar location. In fact, according to the New York Times in 2011, there were more than one billion blinds in the United States alone. People often use them for blocking sunlight, for privacy, and sometime for decoration. Drapery, blinds, and shutters frequently have slats that may be rotated with one or more cords and may be raised or lowered with one or more different cords. These cords typically run long for ease of access, and are especially long when the drapery, blinds, or shutters are maximally raised. Not only do long cords clutter the floor, but they also can have drastic consequences.

Unfortunately, young children are attracted to drapery, blinds, or shutter cords. Often these young children play with the drapery, blinds, or shutter cords. Young children can become entangled within the cords, which can lead to great bodily harm or death. The New York Times reported that over the last 25 years, an average of one child per month has accidently been strangled in blind cords.

In an attempt to mitigate bodily harm and death, cordless blinds were created. However, cordless blinds are more difficult to manufacture than corded blinds, and can cost considerably more in stores, by some estimates, twice as much. Often manufacturers won't make cordless blinds because of the costs or because of little consumer interest. Due to the cost of cordless blinds, window blinds with pull-string cords are still sold in large amounts.

Although multiple news pieces have been reported and articles have been written about these dangers, window blinds pull-string cords still pose a threat to children. Indeed, it is unlikely that window pull-string cords will be discontinued. A need, therefore, exists for third party safety apparatuses, systems, and methods for preventing window blind-related injuries and deaths.

Additionally, a need exists for apparatuses, systems, and methods for predicting possible window blind-related injuries and deaths.

Also, a need exists for apparatuses, systems, and methods for alerting others of possible window blind-related injuries and deaths.

Moreover, a need exists for apparatuses, systems, and methods for aftermarket adapters that predict and alert others to possible window-blind related injuries and deaths.

SUMMARY OF THE INVENTION

The present invention relates to an alarm for detecting and alerting a person of an event where a device is pulled on for an extended period of time. Specifically, the present invention relates to an alarm implemented on a pull-string. Even more specifically, the present invention relates to an apparatus, system, and method of using the same that alerts a person when something becomes tangled or is otherwise caught up in the pull-string of window blinds, shades, or other light-blocking devices.

To this end, in an embodiment of the present invention, an alarm apparatus is provided. The alarm apparatus comprises a contact capable of being pushed in a first direction as a result of force from a second direction; a timer electrically connected to a contact switch, wherein when the contact touches the contact switch the timer begins to count; a spring disposed adjacent the contact switch, wherein the contact rests against the spring when the spring is extended and the contact rests against the contact switch when the spring is compressed; and a signal that activates after the timer has counted a period of time.

In another embodiment of the present invention, an alarm system is provided. The alarm system comprises a string; an alarm apparatus disposed around the string comprising a spring-loaded contact disposed adjacent the string, a contact switch disposed adjacent the spring-loaded contact, wherein pulling on the string forces the spring-loaded contact to compress and touch the contact switch, a timer that begins to count when the spring-loaded contact touches the contact switch, and a signal that activates after the timer has counted a period of time.

Moreover, in another embodiment of the present invention, a method of signaling an alarm is provided. The method comprises the steps of providing a string; providing an alarm apparatus comprising a spring-loaded contact, a contact switch disposed adjacent the spring-loaded contact, a timer that begins to count when the spring-loaded contact touches the contact switch, and a signal that activates after the timer has counted a period of time; and placing the alarm apparatus around the string, such that the string is disposed adjacent the spring-loaded contact and pulling on the string forces the spring-loaded contact to compress and touch the contact switch.

It is, therefore, an advantage and objective of the present invention to provide third party safety apparatuses, systems, and methods for preventing window blind related injuries and deaths.

Additionally, it is an advantage and objective of the present invention to provide for apparatuses, systems, and methods for predicting possible window blind-related injuries and deaths.

Also, it is an advantage and objective of the present invention to provide for apparatuses, systems, and methods for alerting others of possible window blind-related injuries and deaths.

Moreover, it is an advantage and objective of the present invention to provide for apparatuses, systems, and methods for aftermarket adapters that predict and alert others to possible window-blind related injuries and deaths.

Additional features and advantages of the present invention are described in, and will be apparent from, the detailed description of the presently preferred embodiments and from the drawings.

BRIEF DESCRIPTION OF THE DRAWINGS

The drawing figures depict one or more implementations in accord with the present concepts, by way of example only, not by way of limitations. In the figures, like reference numerals refer to the same or similar elements.

DETAILED DESCRIPTION

The present invention relates to an alarm for detecting and alerting a person of an event where a device is pulled on for an extended period of time. Specifically, the present invention relates to an alarm implemented on a pull string. Even more specifically, the present invention relates to an apparatus, system, and method of using the same that alerts a person when something becomes tangled or is otherwise caught up in the pull string of window blinds, shades, or other light blocking devices.

Figure 1:
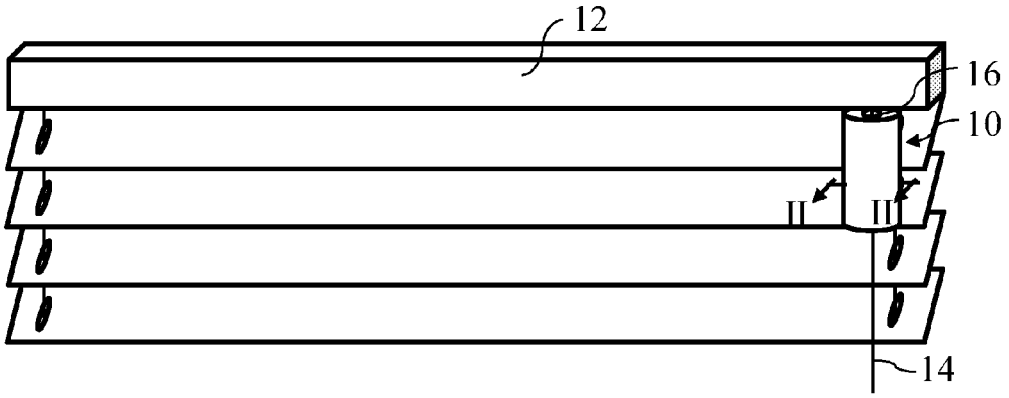
FIG. 1 illustrates a perspective view of an alarm apparatus on a set of blinds in an embodiment of the present invention.

Now referring to the figures, wherein like numerals refer to like parts, FIG. 1 illustrates an alarm apparatus 10 disposed on window blinds 12 in an embodiment of the present invention. The alarm apparatus 10 may be installed on window blinds, drapery, shutters or the like when manufactured but also may be attached after manufacture. In a preferred embodiment, the alarm apparatus 10 may allow a cord 14 to be threaded therethrough. The cord 14 may be string, lace, thread, twine, rope, chain, or other tethering device known to one skilled in the art, typically utilized for pulling thereon for raising and lowering window blinds or other like light-blocking material over a window.

In one embodiment of the present invention, the alarm apparatus 10 may be manufactured in two parts such that the alarm apparatus 10 may be disposed around an existing cord 14. For example, the apparatus 10 may be a clamshell configuration, and may have an opened configuration allowing a cord 14 to be placed therein, and may further be closed around the cord 14 and held together via a closure.

In a preferred embodiment, the apparatus 10 may be attached to a window blind pull-string cord 14 at or near the top of the of the cord 14 when the blinds are extended to fully cover a window, so that the largest amount of cord 14 may be disposed beneath the apparatus 10 as possible. Typically, loosely hanging window blind pull-string cord is dangerous at or near the bottom thereof, where a child may reach the same from the ground.

The apparatus may be held in placed on the cord via a holder (not shown) at the top of the apparatus, allowing the cord 14 to hang loosely within the apparatus 10 and therebeneath. For example, the holder may simply be a knot tied in the cord 14 and placed within the apparatus at an upper hole therein, such that the apparatus 10 may rest on the knot, preventing the apparatus 10 from descending the cord 14 and holding the apparatus 10 in place by gravity. Alternatively, the holder may be a clip or other like device that may be disposed on the cord 14 to prevent movement of the apparatus 10 yet still allow the cord 14 to hang freely therebeneath. Thus, the cord 14 may pass freely through a bottom hole in the apparatus 10 and may move independently through the bottom hole thereof. In such an embodiment, however, the apparatus 10 may lower and rise with the pull-string cord 14 as the pull string cord 14 is pulled and/or released to raise, lower or otherwise move the window blinds or other window covering.

In an alternate embodiment, the apparatus 10 may be disposed on a window blind headrail, a window frame, or other similar non-moving location. In such an embodiment, the pull-string cord 14 may pass through the apparatus 10, as described herein, but while the pull-string cord 14 may move, the apparatus 10 may remain stationary and rigidly attached to the non-moving location. Therefore, the pull-string cord 14 may not be knotted or clipped to the apparatus 10, as described above, but may move entirely independently of the stationary apparatus 10.

The apparatus 10 may be relatively small and may be powered via any means apparent to one of ordinary skill in the art. In a preferred embodiment, the apparatus 10 may be powered via direct current battery power, such as via one or more batteries that may easily fit within the apparatus 10. For example, the apparatus 10 may be powered via a plurality of small batteries commonly referred to as watch batteries, providing sufficient power for extended period of time to power the apparatus 10, as described below. Alternatively, the apparatus 10 may be powered via solar power, having one or more solar panels and energy storage devices therein for storing power generated by the solar panels.

Figure 2:
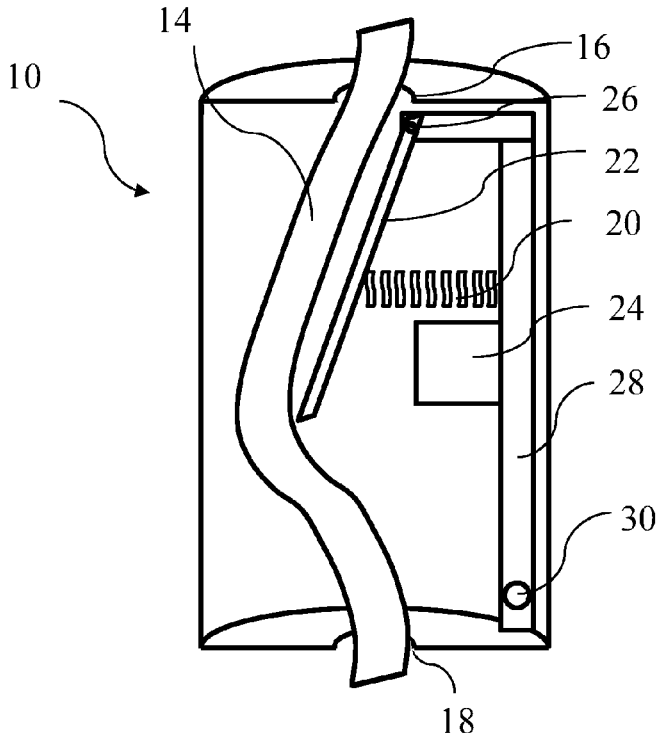
FIG. 2 illustrates a cross-section view of the alarm apparatus in a first configuration in an embodiment of the present invention.

FIG. 2 illustrates a cross-sectional view of the alarm apparatus 10 and its components in an embodiment of the present invention. The alarm apparatus 10 may contain a spring 20 that may push a contact 22 away from a contact switch 24. As shown in the drawings, the contact 22 may be attached to a hinge 26, whereby the contact 22 may rotate about the hinge 26 towards the contact switch 24 when the contact 22 is placed under a force. Alternatively the contact 22 may solely be attached to the spring 20, whereby the contact 22 may move horizontally towards the contact switch 24 when the contact 22 is placed under a force. Of course, numerous methods of moving contact 22 towards the contact switch 24 may be implemented without diminishing the scope of the present invention, and the present invention should not be limited as described herein.

Figure 3:
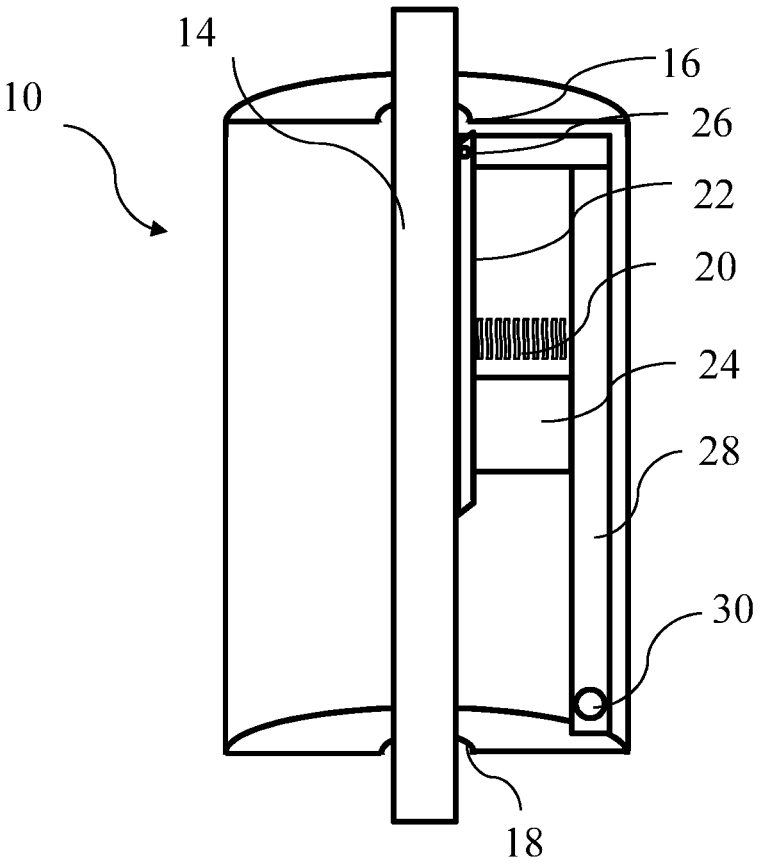
FIG. 3 illustrates a cross-section view of the alarm apparatus in a second configuration in an embodiment of the present invention.

The slack in the cord 14 that may form within the alarm apparatus 10 is shown in FIG. 2. FIG. 3 illustrates the cord 14 without slack therein, such as if pulled from beneath. In a first configuration, illustrated in FIG. 2, the spring 20 may push against contact 22 and hold contact 22 in place away from the switch 24. While the cord 14 may naturally hang down in a straight line due to the pull of gravity, the spring 20 and contact 22 may push against the cord 14 and cause the slack to form as shown in FIG. 2. As illustrated in FIG. 3, the cord 14 may be pulled, which may cause the contact 22 and the spring 20 to be compressed until the contact 22 touches the contact switch 24.

Of course, any spring disclosed herein may be adjustable to change the amount of force required to activate the alarm apparatus. This may be accomplished using screw connected to one end of the spring, wherein rotating said screw may lengthen and/or shorten the spring, increase and/or decrease the spring tension, and thereby increase and/or decrease the amount of force required to compress the spring, depending on the rotation of the screw. Of course, this methodology may be utilized on a linear spring, however, alternate methods may be applied to alternate springs as known to those skilled in the art to increase and/or decrease spring tension. Additionally, different springs of different materials may be inserted, replaced, removed, etc. to change the tension, resistivity, and other elements of the springs.

Figure 4A:
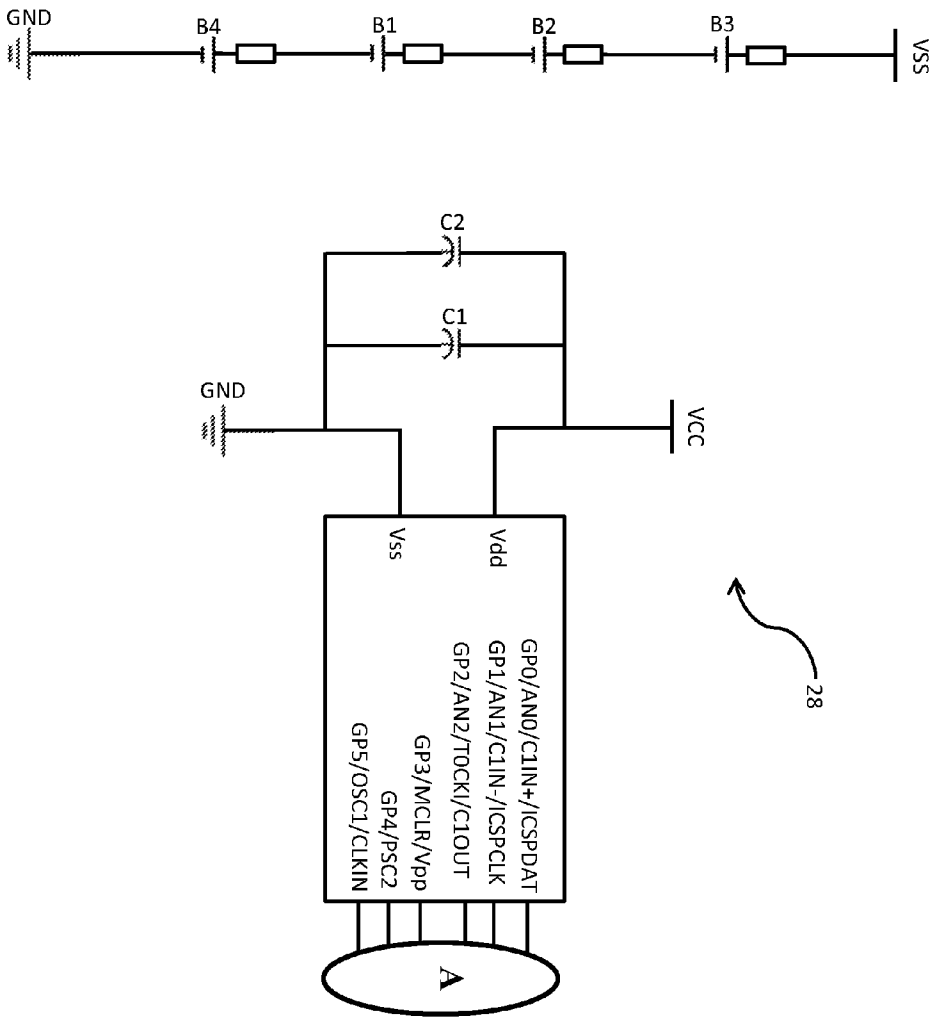
FIGS. 4A-4B illustrate a circuitry schematic of one implementation of the alarm apparatus in an embodiment of the present invention.
Figure 4B:
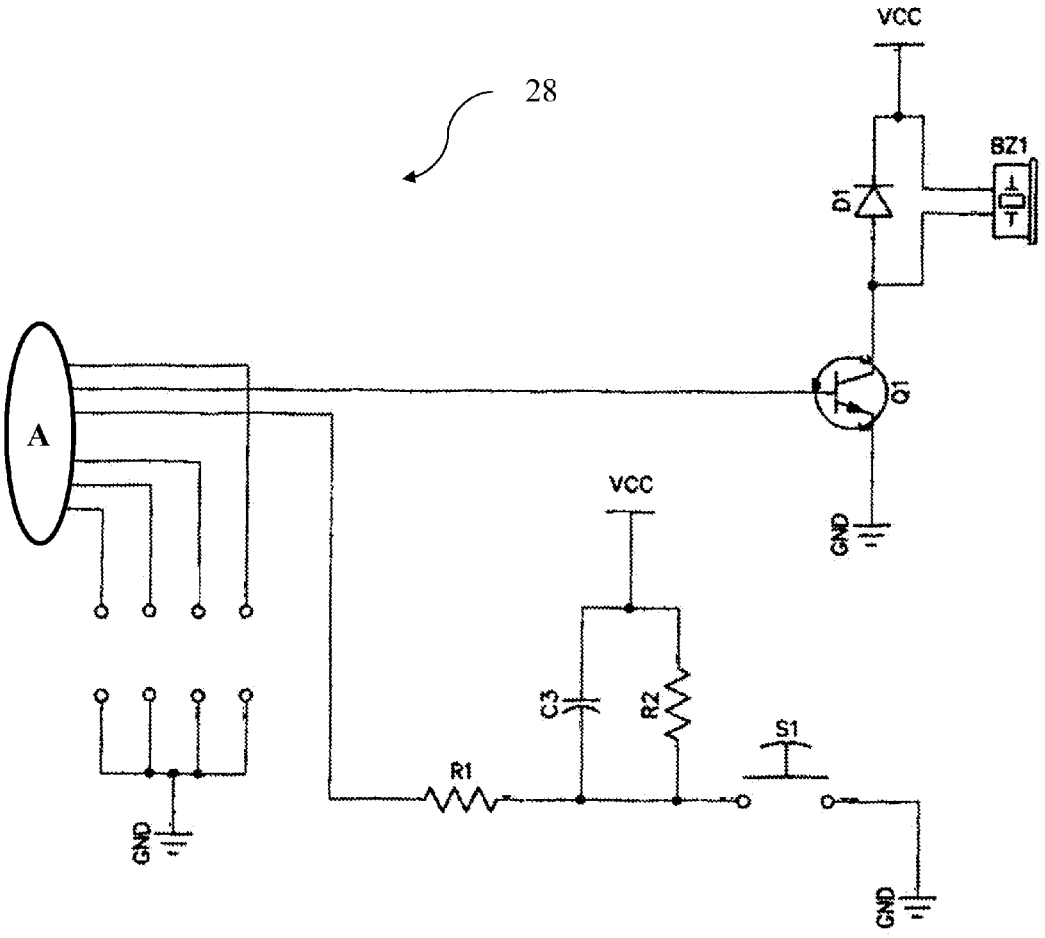

The alarm apparatus 10 may further comprise circuitry 28. Circuitry 28 may be a circuit board, a microprocessor, a resistor, a capacitor, a diode, a transistor, a switch, or any other known circuitry and components thereof known to one skilled in the art. A preferred embodiment of the circuitry 28 is shown in FIGS. 4A-4B, but the present invention should not be limited as shown and described herein. Of course, the circuitry 28 may be designed in any way such that the following process may be implemented.

Specifically, the circuitry 28 may obtain a go signal from the contact switch 24 when the contact 22 touches the contact switch 24, such as when the cord 14 is pulled, causing the cord 14 to tighten and straighten within the apparatus 10, ultimately causing tension in the cord, which causes the contact 22 to touch the switch 24. The circuitry 28 may obtain a stop signal from the contact switch 24 when the contact 22 is released from the contact switch 24, such as when the cord 14 is released.

Upon receiving the go signal, the circuitry 28 may activate a timer and may count the time elapsing upon receiving the go signal. The circuitry 28 may compare the time counted by the timer, which may be the time after receiving a go signal, to a pre-programmed time. If the timer's count matches or exceeds the pre-programmed time, the circuitry 28 may create an alarm signal.

While the present invention discusses sending signals between electrical components, the present invention is not meant to be limited to physical electrical connections such as wires, busses, nodes, paths, logic gates, circuitry, circuit boards, and the like. Where possible, such as in the transmission of information and signals, wireless transmission of the same may be alternatively utilized without departing from the scope of the present invention. Wireless transmission of signals may be possible for at least the go signal, the stop signal, and the alarm signal. Specifically, different wireless frequencies may be associated with different signals such that the components described herein may independently communicate.

Alternatively in another embodiment, the user may be able to program in a user-programmed time, where a user may specify the time compared against the time after receiving the go signal, wherein the circuitry 28 may compare the time counted by the timer to the user-programmed time.

The circuitry 28 may stop counting upon receiving a stop signal, which may occur when the contact 22 breaks contact with the switch 24, which may be caused when the cord 14 is released. Thus, if the circuitry 28 receives the stop signal and the timer does not reach the pre-programmed (or user-programmed) time, then the alarm signal may not be triggered. Therefore, the cord 14 may be used as normal when a user wishes to simply adjust the window blinds. It is anticipated that normal usage of window blinds takes place in a lesser amount of time than the pre-programmed (or user-programmed) time programmed into the circuitry, so that normal or typical usage of the cord 14 will not trigger the alarm signal. In an abnormal or atypical situation, such as when a child is playing with the window blind cord 14 or accidentally becomes entangled in the cord 14, downward force on the cord 14 longer than the pre-programmed (or user-programmed) time will trigger the alarm condition.

The pre-programmed time (or user-programmed time) may preferably be between 1 and 5 seconds, preferably 3 seconds, but may be shorter or longer in duration as apparent to one of ordinary skill in the art. In certain cases, a user may wish to have the length of time shorter than 5 seconds for safety. Moreover, it may be discerned that a length of time longer than 5 seconds may be desired if it typically takes longer than 5 seconds to adjust a particular set of window blinds.

When the circuitry 28 creates the alarm signal, the alarm signal may be sent to a notification device 30. The notification device 30 may be an audio alarm such as a sound from a speaker, a visual alarm such as a flashing light, a wireless transmission device, another known alarming technique known to one skilled in the art, or any combination thereof. As visual and audio alarms can sometimes go unnoticed, the notification device 30 may be able to transmit a signal wirelessly to a user's cell phone through a text message, a phone call, an application, or any combination thereof. Alternatively, wireless receivers/transmitters may be located about a house or business that may receive a wireless transmission signal from the notification device 30, alert the user through an audio or visual alarm, and re-transmit the signal to other wireless receiver/transmitters in the house or business.

In an embodiment, a reset button or other reset means may be provided to allow a user to turn off the alarm signal once the danger is eliminated or if the user accidentally triggers the alarm by pulling on the cord for longer than the predetermined programmed time. In one embodiment, the alarm may merely turn off once tension is released from the cord (or otherwise releasing the contact switch 24 from the contact 22). However, in this embodiment, if tension is released during an ongoing emergency, then the alarm may not signal again for another 1 to 5 seconds, preferably 3. In this embodiment, the apparatus may be prematurely reset and may waste precious time in announcing an emergency. Therefore, in an alternate embodiment, the alarm may continue for a period of time after tension is released. Preferably, the alarm may continue indefinitely until a person resets the apparatus manually. As described above, this may be a reset switch on the apparatus, but also may be a remote reset switch where the apparatus wirelessly transmits the alarm signal to other devices. In an alternate embodiment, the apparatus may be reset by tugging or pulling on the cord (and thus making the contact switch 24 tough the contact 22) multiple times. Of course, in this embodiment, the apparatus may also be prematurely reset during an emergency.

In an example of the present invention, the apparatus of the present invention is disposed at or near the top of the window blind cord when the window blinds are fully extended to cover the window. Thus, the fullest amount of cord may be disposed beneath the apparatus 10 without interfering with the usage of the cord when pulled by a user. As a user wishes to adjust the window blinds, he or she grasps the cord and manipulates the same as normal to adjust the window blinds over the windows, whether to raise the blinds fully or partially. When manipulating the cord, the switch therein is triggered and the go signal is received by the circuitry. Typically, the amount of time required to adjust the window blinds is less than the predetermined time programmed into the circuitry, and the stop signal is received by the circuitry prior to triggering an alarm.

In another example of the present invention, the apparatus of the present invention may be grasped by a baby or child and pulled, triggering the go signal from the switch to the circuitry. As the baby or child continues to play with the cord or becomes entangled thereby, the go signal continues to be received by the circuitry for a length of time matching or longer than the predetermined time programmed into the circuitry. In such an event, the alarm is triggered, alerting an adult that the child is playing with or entangled in the cord.

The present invention may also condition a baby or child to avoid playing with window blind cords. Specifically, while playing with a window blind cord having an apparatus of the present invention as described above attached thereto, the alarm may be triggered after the predetermined programmed time period, frightening the baby or child, and causing the baby or child to avoid the cord in the future.

In an alternate embodiment of the present invention, designed to condition or frighten a child from playing with a window blind cord, the alarm condition of the apparatus 10, as illustrated above, may be triggered immediately upon pulling of the same, and may be turned off when the cord is let go. Specifically, the alarm may be triggered immediately upon receiving the go signal and may stop immediately upon receiving the stop signal. Thus, for example, a loud audible alarm may emanate from the apparatus 10 or another audio source immediately upon pulling and may stop when the cord is released. The loud audible alarm may cause a baby or child to avoid pulling on the cord in the future.

In yet another embodiment of the present invention, the apparatus 10 may cause an audible alarm to be triggered immediately upon pulling the cord which may then be silenced upon letting go of the cord, as described above, but may further provide a permanent alarm when the cord is pulled for longer than the predetermined programmed time, whereupon the alarm signal (or a different alarm signal) may be permanently triggered until reset by an adult or other user. For example, an audible alarm may be triggered immediately upon pulling the cord, while an audible and/or inaudible alarm may be triggered if the cord is pulled for longer than the predetermined programmed time period. Thus, the audible alarm that may immediately sound when the cord is pulled may act to condition a baby or child to avoid the cord in the future, but the permanent alarm that may be triggered after pulling for the predetermined time period may act to alert an adult that a baby or child may be entangled in the cord.

While the present invention is illustrated in an embodiment shown in FIGS. 2 and 3, it should be noted that any manner of triggering an alarm when a window blind cord is pulled for longer than a predetermined time is contemplated by the present invention, and the invention as described herein should not be limiting.

For example, alternate embodiments of an alarm apparatus are shown and described in FIGS. 5-11. An alarm apparatus 110, shown in FIG. 5, may comprise a notification device 130, a power source 120, and a circuit board 128. The notification device 130 may create an audio alarm such as a sound from a speaker, a visual alarm such as a flashing light, a contact alarm such as a vibration or low-intensity shock or pulse, a wireless transmission, another known alarming technique known to one skilled in the art, or any combination thereof. Of course, these alarms may be produced by sources such as a horn or instrument, a display screen, a vibration generator, a voltage generator, a radio wave generator, a wired or wireless transmitter, a short message service, a multimedia message service, a telephone service, and the like.

As local visual and audio alarms can sometimes go unnoticed, the notification device 130 may be able to transmit a signal wirelessly to a person's cell phone through a text message, a phone call, an application, or any combination thereof. Even further, the alarm apparatus 110 may further include a camera and/or a microphone to send additional information to a person's cell phone, emergency service providers, and/or other interested parties. Alternatively, wireless receivers/transmitters may be located about a house or business that may receive a wireless transmission signal from the notification device 130, alert the user through an audio or visual alarm, and re-transmit the signal to other wireless receiver/transmitters in the house or business. Preferably, in one embodiment, the notification device 130 may be a transducer that may transmit audible sound. However, the alarm apparatus 110 may also comprise multiple notification devices 130 to transmit different alarm signals as described herein.

Figure 5:
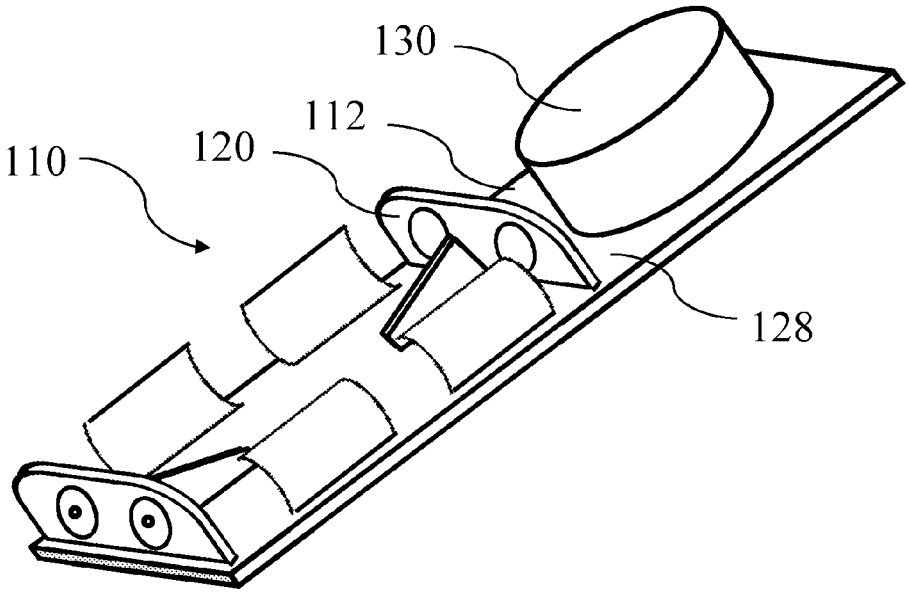
FIG. 5 illustrates a top perspective view of an alternate alarm apparatus in a preferred embodiment of the present invention.

The notification device 130 and the power source 120 may be electrically connected to the circuit board 128 on a first side 112 of the alarm apparatus 110. Specifically, the power source 120 may be a battery pack, as shown in FIG. 5, such that the alarm apparatus 110 has mobile power. The power source 120 may be a rechargeable battery such as a lithium-ion battery, a replaceable battery, or any other like mobile power source known to those skilled in the art. Alternatively, the alarm apparatus 110 may be hardwired to an external power source (not shown), such as an outlet, a solar panel, an external battery, a generator, or other power source known to one skilled in the art. Of course, the power source 120 may provide the alarm apparatus 110 with voltage and current required to send/receive signals, create/cease an alarm, perform logic and comparisons, and other related electrical necessities as described expressly or inherently herein.

Figure 6:
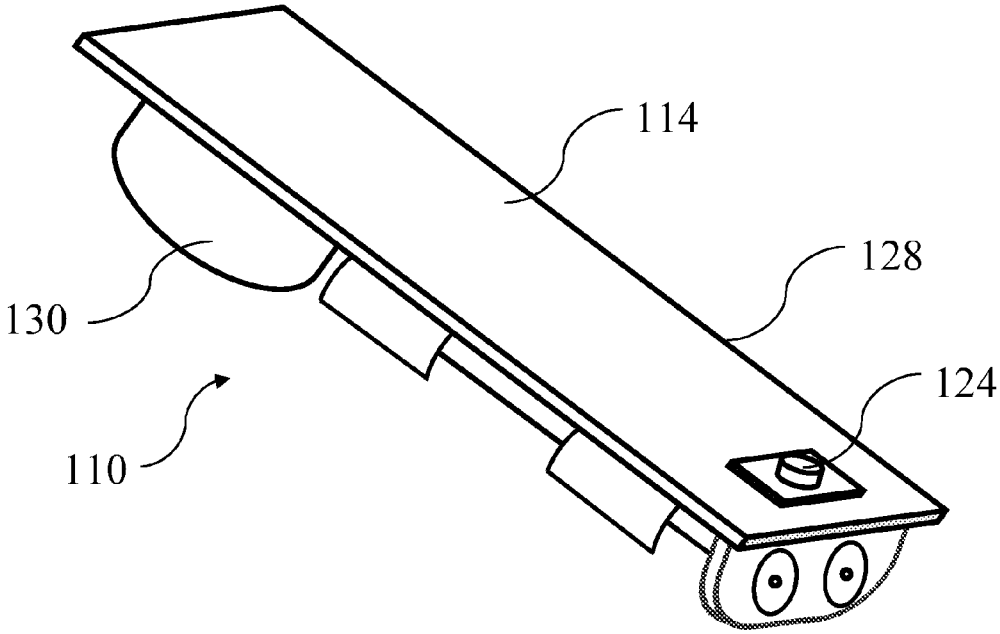
FIG. 6 illustrates a bottom perspective view of the alternate alarm apparatus in a preferred embodiment of the present invention.

As shown in FIG. 6, a switch 124 may be electrically connected to the circuit board 128 on a second side 114 of the alarm apparatus 110. The switch 124 may be a physical button that may be engaged when pressure is exerted thereon. Similar to the previous discussion, the circuit board 128 may obtain a go signal from the switch 124 when the switch 124 is engaged, such as when a cord is pulled and said cord presses against the switch 124. The circuit board 128 may obtain a stop signal from the switch 124 when the switch 124 is disengaged, such as when said cord is released and no longer presses against the switch 124. Specifics regarding how a cord may be used to press against the switch 124 are further discussed below with regard to FIGS. 7 and 8. Of course, alternate methods of engaging the switch 124 may be implemented without departing from the scope of the present invention.

Upon receiving the go signal, the circuit board 128 may activate a timer and may count the time elapsing upon receiving the go signal. The circuit board 128 may compare the time counted by the timer, which may be the time after receiving a go signal, to a pre-programmed time. If the timer's count matches or exceeds the pre-programmed time, the circuit board 128 may create an alarm signal.

Alternatively in another embodiment, the user may be able to program in a user-programmed time, where a user may specify the time compared against the time after receiving the go signal, wherein the circuit board 128 may compare the time counted by the timer to the user-programmed time.

The circuit board 128 may stop counting upon receiving a stop signal, which may occur when the switch 124 is disengaged, such as when a cord is released (further discussed below). Thus, if the circuit board 128 receives the stop signal and the timer does not reach the pre-programmed (or user-programmed) time, then the alarm signal may not be triggered. Therefore, a cord may be used normally to adjust window blinds without alarm. In one embodiment, it is anticipated that normal usage of window blinds and associated cords takes place in a lesser amount of time than the pre-programmed (or user-programmed) time programmed into the circuitry, so that normal or typical usage of cords will not trigger the alarm signal. In an abnormal or atypical situation, such as when a child, animal, or other individual is playing with a window blind cord or accidentally becomes entangled in a cord, a downward force on the cord for longer than the pre-programmed (or user-programmed) time may trigger the alarm condition.

The pre-programmed time (or user-programmed time) may be between 1 and 5 seconds, preferably 3 seconds, but may be shorter or longer in duration as apparent to one of ordinary skill in the art. In certain cases, a user may wish to have the length of time shorter than 5 seconds for safety. Moreover, it may be discerned that a length of time longer than 5 seconds may be desired if it typically takes longer than 5 seconds to adjust a particular set of window blinds.

When circuit board 128 creates the alarm signal, the alarm signal may be sent, electrically or wirelessly, to the notification device 130. Upon receiving the alarm signal, the notification device 130 may create an alarm as described above. Preferably, in one embodiment, the notification device 130 may create an audible alarm when the alarm signal is sent to the notification device 130. When a stop signal is created upon release of the switch 124, the stop signal may be sent, electrically or wirelessly, to the notification device 130. The stop signal may traverse through the circuit board 128 and any logic thereon. Alternatively, the notification device 130 may be directly connected to a stop signal electrical bus or may directly receive wireless transmission of the stop signal, such that a stop signal is directly sent to the notification device instead of traversing through redundant electrical or wireless connections. Upon receiving the stop signal, the notification device 130 may cease the alarm previously created. Preferably, in one embodiment, the notification device 130 may cease the audible alarm when the stop signal is sent to the notification device 130.

Figure 7:
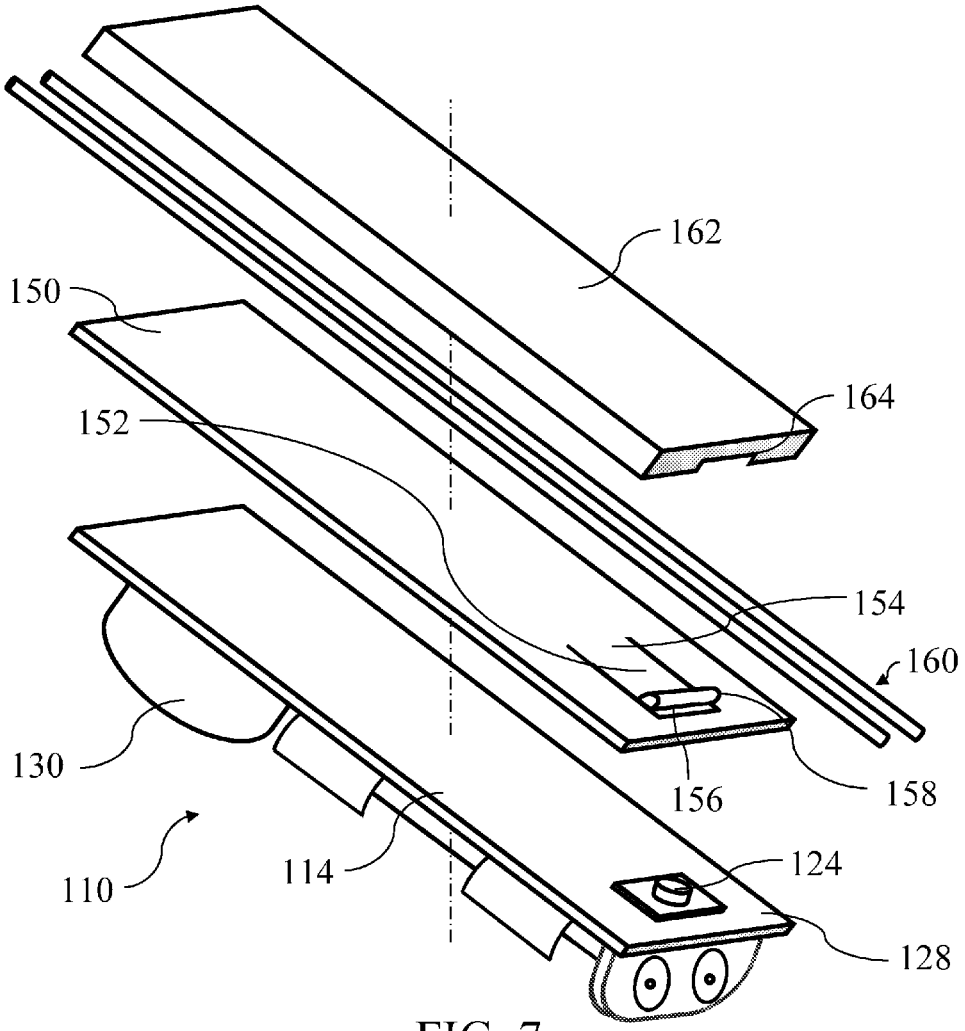
FIG. 7 illustrates an exploded view of the alternate alarm apparatus with an activation portion, a cord, and a back cover in a preferred embodiment of the present invention.

As shown in FIG. 7, an activation portion 150 may be disposed adjacent the second side 114 of the alarm apparatus 110. The activation portion 150 may be similar in size to the circuit board 128, such that the two may align for use within a housing (not shown) that is further described below. Specifically, a leaf spring 152 may be cut from the activation portion 150 such that the leaf spring 152 may move independently from the activation portion 150. Particularly, the activation portion 150 may be made from a resilient material, such as plastic, polymer, metal, fiber glass, or other like material known to one skilled in the art. The resiliency of the activation portion 150 may be directly proportional to the spring constant of the leaf spring 152.

Even more specifically, the leaf spring 152 may be connected to the activation portion 150 on a first side 154 such that a second side 156 may move independent of the activation portion 150. Specifically, force may be applied to the second side 156 thereby moving the second side 156 independent of the activation portion 150. When the force is removed, the second side 156 may oscillate and may return to rest where it was disposed prior to the application of force. A lip 158 may be disposed on the second side 156 of the leaf spring 152 to more easily apply force to the second side 156 of the leaf spring 152. The lip 158 may allow a cord 160 to press against the second side 156 of the leaf spring 152 as further discussed below.

The cord 160 may be a single line, or the cord 160 may be a plurality of lines like that shown in FIG. 7. The cord 160 may be disposed adjacent the leaf spring 156 and rest against the lip 158 in one embodiment of the present invention. To ensure that the cord 160 is maintained against the lip 158, a back cover 162 may be disposed over the cord 160 and the activation portion 150. Specifically, the back cover 162 may have a plurality of openings 164 disposed on a top and a bottom of the back cover 162 to allow the cord 160 to traverse between the back cover 162 and the activation portion 150, while also allowing the cord 160 to go in to and out from under the back cover 162. The plurality of openings 164 may also maintain the cord 160 in an alignment such that the cord may always be disposed against the lip 158.

Figure 8:
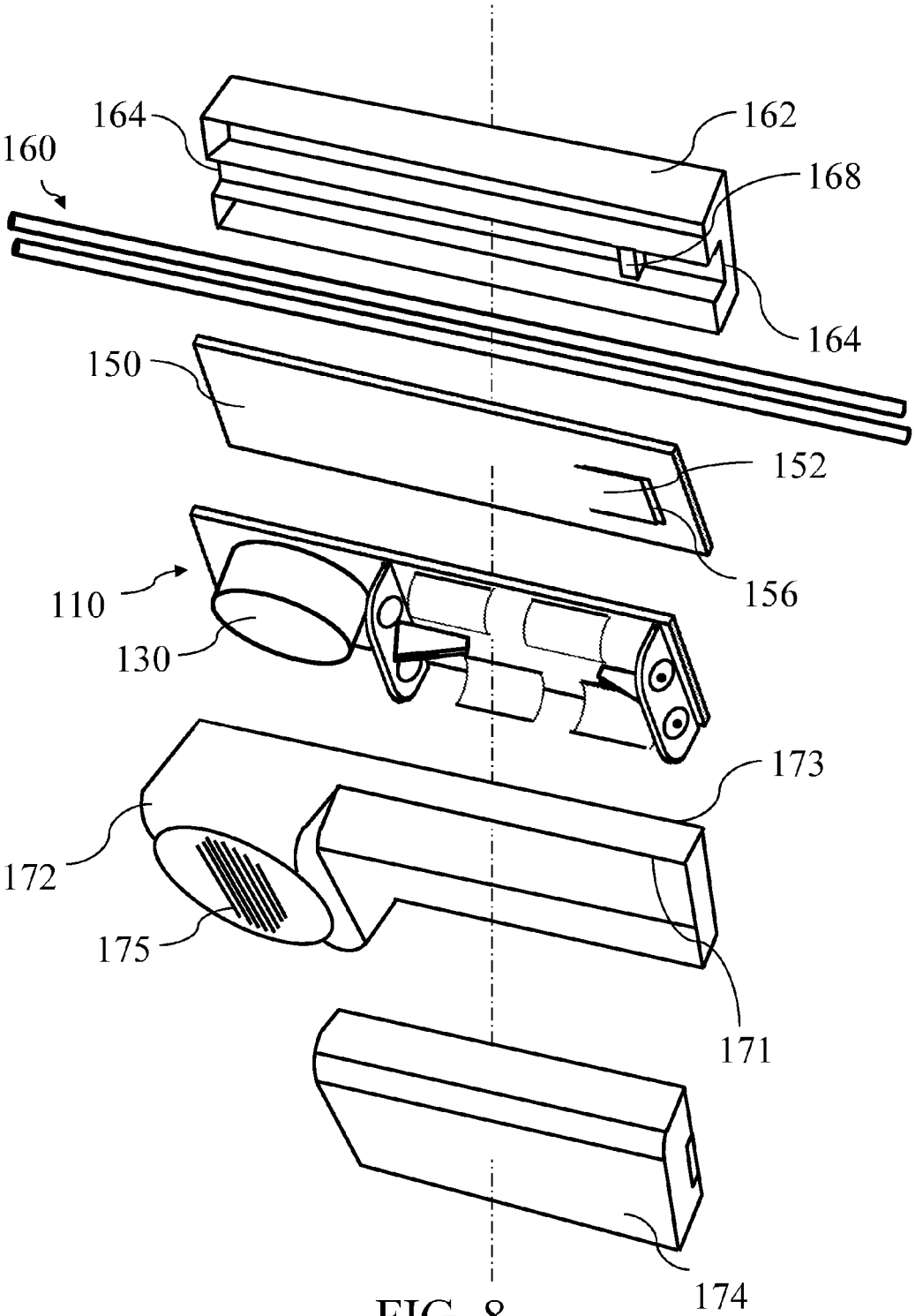
FIG. 8 illustrates an exploded view of a complete housing with the alternate alarm apparatus, the activation portion, the cord, and the back cover in a preferred embodiment of the present invention.
Figure 9:
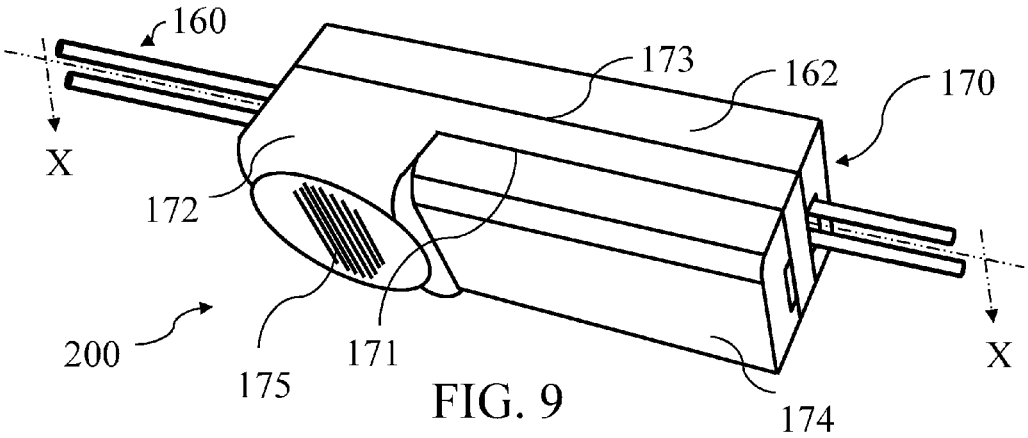
FIG. 9 illustrates a perspective view of the complete housing with the cord therethrough in a preferred embodiment of the present invention.
Figure 10:
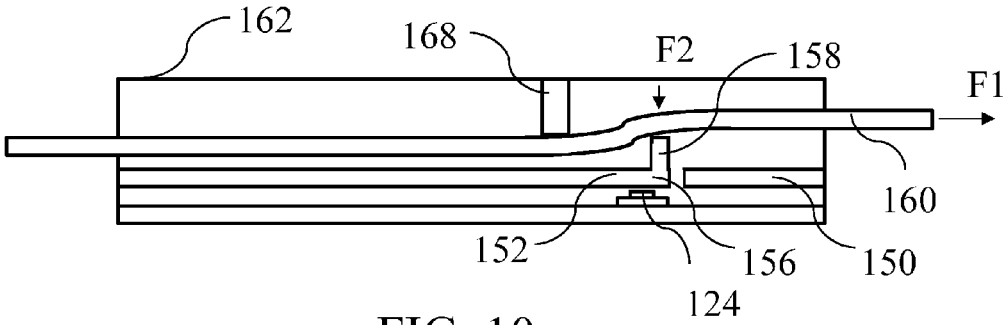
FIG. 10 illustrates a cross-sectional view of a ridge and a lip interacting with the cord within the housing in a preferred embodiment of the present invention.

As further shown in FIGS. 8-9, the alarm apparatus 110 may be completely enclosed in a housing 170. The housing 170 may be formed by the back cover 162 in connection with a front cover 172 and a power cover 174. Specifically, the power cover 174 may be disposed on a first side 171 of the front cover 172 and the back cover 162 may be disposed on a second side 173 of the front cover 172. The alarm apparatus 110, the activation portion 150, and the cord 160 may be disposed within a space formed between the front cover 172 and the back cover 162, as indicated by the broken line in FIG. 8. The front cover 172 may have a grating 175 or alternate opening to allow any visual, audio, or other notification from the notification device 130 to exit the front cover 172 unimpeded or uninterrupted. When the power cover 174, the front cover 172, the alarm apparatus 110, the activation portion 150, the cord 160, and the back cover 162 are placed together, an alarm system 200 may be formed, as shown in FIG. 9.

Additionally shown in FIG. 8, the back cover 162 may have ridge 168 disposed thereon. The ridge 168 may press against the cord 160 when the cord 160 is disposed between the activation portion 150 and the back cover 162. The ridge 168 may act together with the lip 158, as further shown in FIG. 10, to displace a length of the cord 160. In one embodiment, when a force is applied to the cord 160 downwardly, as indicated by arrow labeled F1, the cord 160 may straighten and apply a force laterally, as indicated by arrow label F2. The lateral force F2 may contact and displace the lip 158 and the second side 156 of the leaf spring 152, which may then engage the switch 124. Therefore, the switch 124 may continuously be engaged by the second side 156 of the leaf spring 152 as long as force is applied to the cord 160 downwardly. In this manner, an alarm may be activated after a prolonged force is applied to the cord 160, as would be the case if a child, animal, or the like was caught in the cord 160.

Figure 11:
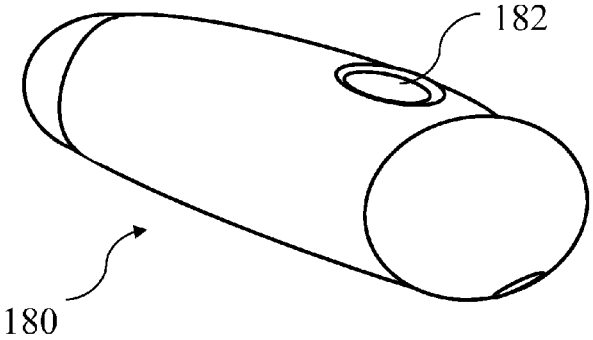
FIG. 11 illustrates a perspective view of an alternate complete housing in an alternate embodiment of the present invention.

An alternate housing 180 is shown in FIG. 11. The alternate housing 180 may enclose the alarm apparatus 110, the activation portion 150 including the lip 158, the cord 160, and the ridge 168 therein. Additionally, a reset button 182 may be disposed thereon for deactivating, reactivating, resetting, or otherwise refreshing the alarm apparatus 110 as described herein. Of course, the reset button 182 may be disposed on the housing 170, or any other alternate housing enclosing an alarm apparatus as previously described.

Figure 12A:
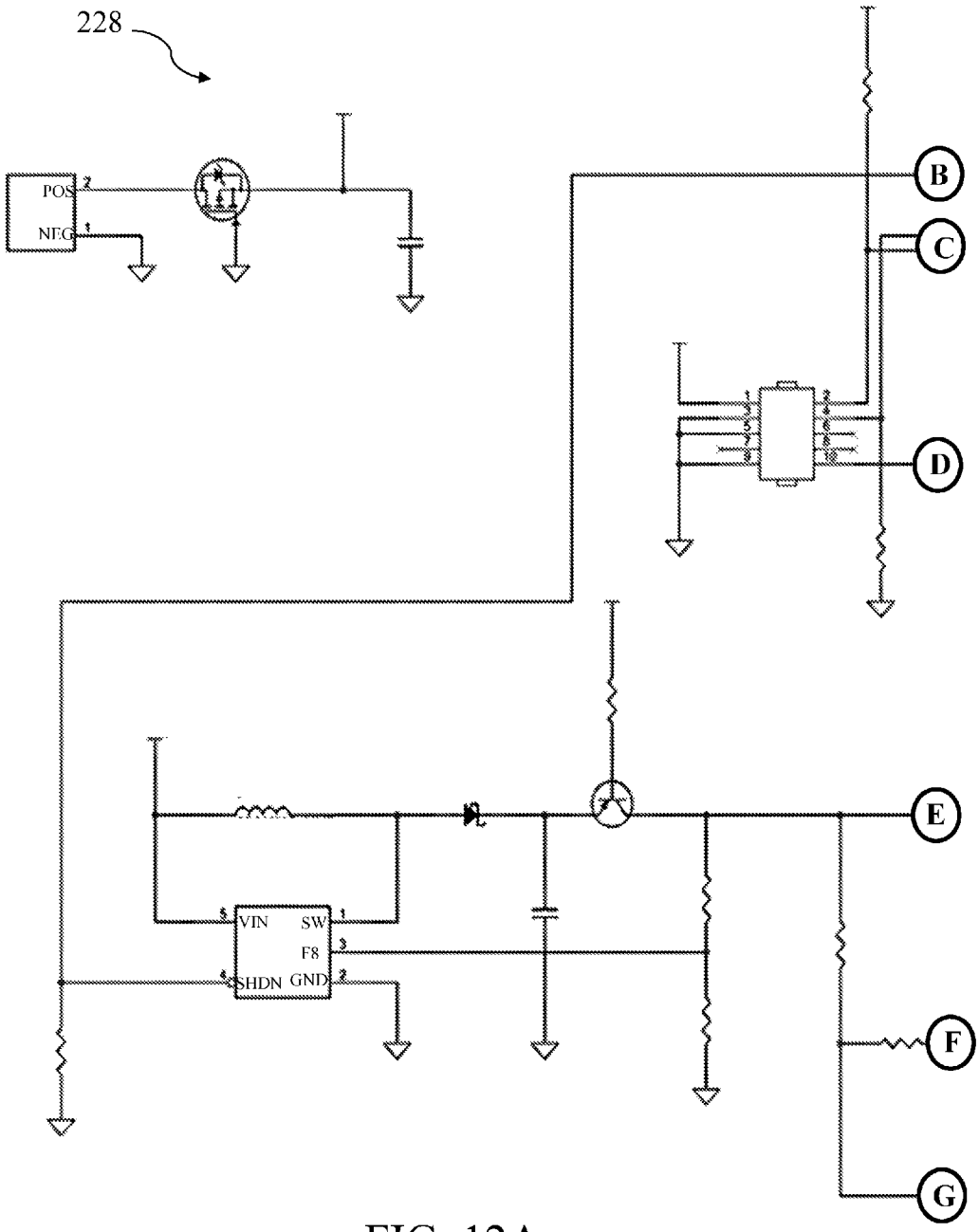
FIGS. 12A-12B illustrate a circuitry schematic of an alternate implementation of the alarm apparatus in an embodiment of the present invention.
Figure 12B:
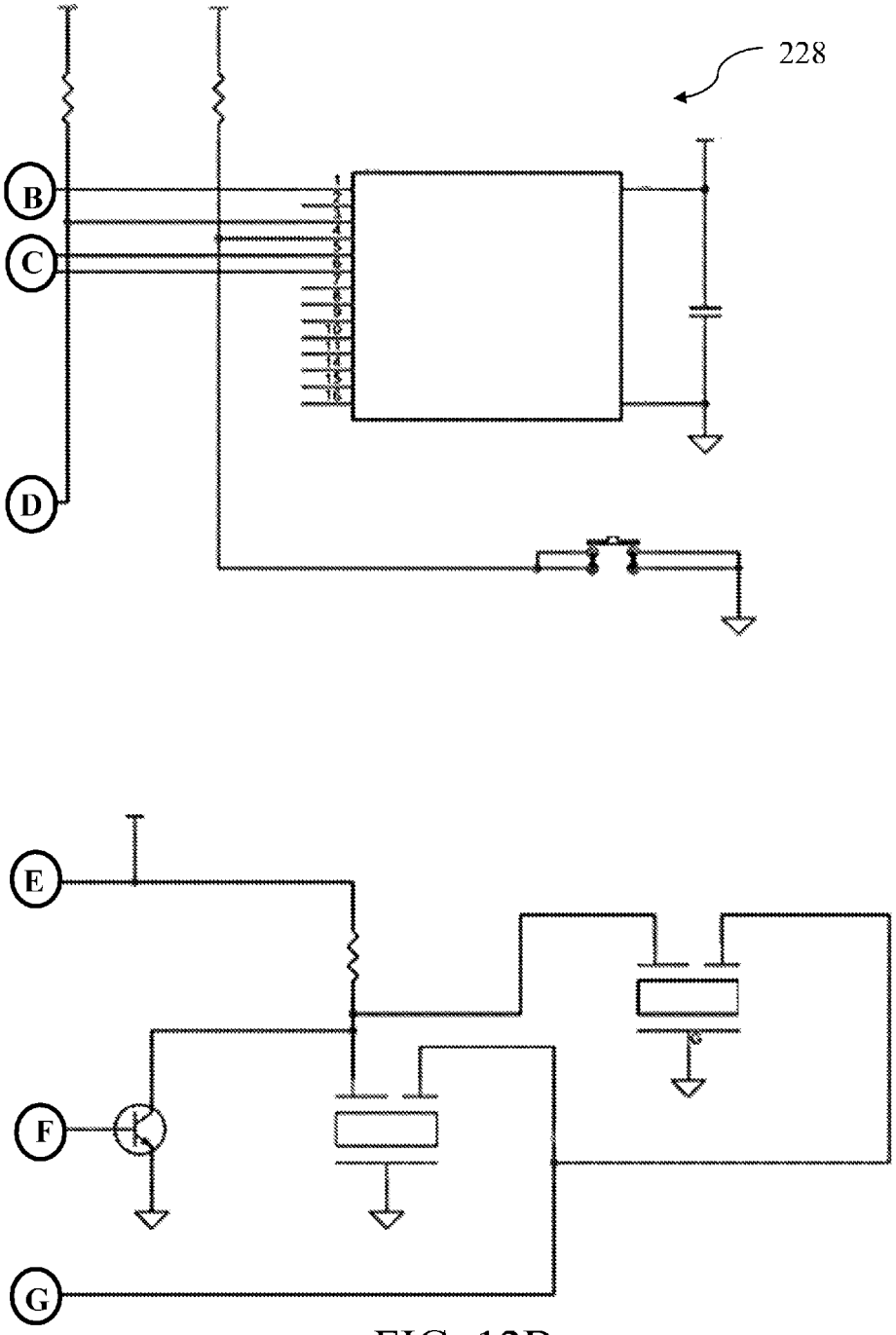

As shown in FIGS. 12A-12B, the alarm apparatus 110, or an alternate alarm apparatus, may comprise circuitry 228. Circuitry 228 may be a circuit board, a microprocessor, a resistor, a capacitor, a diode, a transistor, a switch, any other known circuitry and components thereof known to one skilled in the art, and any combination thereof. A preferred embodiment of the circuitry 228 is shown in FIGS. 12A-12B, but the present invention should not be limited as shown and described herein. Of course, the circuitry 228 may be designed in any way such that the processes described herein may be implemented.

While the present disclosure references window blinds, drapery, and the cords related thereto, the present invention may have alternate applications apparent to a person having ordinary skill in the art. For example, the present invention may be installed on a fishing line, instead of a window blind cord as discussed above. When the present invention is applied to a fishing line, a fisherman may be alerted when a fish engages the bait, hook, lure, or other device disposed on an end of the fishing line. Specifically, the fish may tug on the fishing line, forcing the line to contact the switch as similarly described above. This application may appeal to ice fishermen, fishermen who use multiple lines, or any other person in need of being alerted when a line is pulled taught. In fact, the present invention may be generally used in any situation to beneficially alert a person that a line, cable, cord, or other string is pulled taut. Of course, the timer may be adjusted to alert a person depending on the situation the present invention is utilized in.

It should be noted that various changes and modifications to the presently preferred embodiments described herein will be apparent to those skilled in the art. Such changes and modifications may be made without departing from the spirit and scope of the present invention and without diminishing its attendant advantages. Further, references throughout the specification to "the invention" are nonlimiting, and it should be noted that claim limitations presented herein are not meant to describe the invention as a whole. Moreover, the invention illustratively disclosed herein suitably may be practiced in the absence of any element which is not specifically disclosed herein.

I claim:

1. An apparatus for creating an alarm for prevention of cord related injuries and deaths when force is applied to a cord, the apparatus comprising:

a housing having a first opening on a top of the housing and a second opening on a bottom of the housing thereby creating a chamber within the housing between the first opening and the second opening;

a cord having a height above a surface, wherein the housing is disposed around the cord such that the cord is disposed within the chamber;

a contact disposed within the housing adjacent the cord, the contact configured to move in a first direction as a result of force applied to the cord;

a switch disposed within the housing adjacent the contact;

a timer electrically connected to the switch, wherein the timer begins to count when the contact engages the switch; and a circuit electrically connecting the timer to a notification device having an alarm, said circuit creating a first signal after the timer has counted a period of time, said first signal triggering the alarm of the notification device.

2. The apparatus of claim 1 further comprising:

a ridge extending from a back cover of the housing into the chamber; and a lip extending from the contact towards the back cover;

wherein the ridge is disposed adjacent the lip and further wherein a first portion of the ridge is disposed above a second portion of the lip.

3. The apparatus of claim 1 further comprising a reset button disposed on an external surface of the housing and electrically connected to the circuit, said reset button restarting the timer and terminating the alarm when engaged.

4. The apparatus of claim 1 further comprising a second signal that activates when the switch is disengaged, said second signal terminating the alarm.

5. The apparatus of claim 1 wherein the notification device is selected from the group consisting of a speaker, a horn, an instrument, a light, a display, a vibration generator, a wireless transmitter, a wired transmitter, a voltage generator, and any combination thereof.

6. The apparatus of claim 1 wherein the period of time is between one and five seconds.

7. The apparatus of claim 1 wherein the period of time is three seconds.

8. The apparatus of claim 1 wherein the period of time is programmable by a user.

9. A system for creating an alarm for the prevention of cord related injuries and deaths, the system comprising:

a cord hanging a height above a surface;

an alarm apparatus comprising a housing having a first opening on a top of the housing and a second opening on a bottom of the housing thereby creating a chamber between the first opening and the second opening, wherein the housing is disposed around the cord such that the cord is disposed within the chamber, a contact disposed within the housing adjacent the cord, wherein the contact is pushed in a first direction as a result of a force applied to the cord, a switch disposed within the housing adjacent the contact, a timer electrically connected to the switch, wherein the timer begins to count when the contact engages the switch, and a circuit electrically connecting the timer to a notification device, wherein the circuit creates a first signal after the timer has counted a period of time, said first signal triggering the notification device's creation of an alarm.

10. The system of claim 9 further comprising:

a ridge extending from a back cover of the housing into the chamber and displacing a first length of the cord; and a lip extending from the contact towards the back cover and displacing a second length of the cord;

wherein the ridge is disposed adjacent the lip such that a third length of cord is displaced between the ridge and the lip.

11. The system of claim 9 further comprising a reset button disposed on an external surface of the housing and electrically connected to the circuit, said reset button restarting the timer and terminating the alarm when engaged.

12. The system of claim 9 further comprising a second signal that activates when the switch is disengaged, said second signal terminating the alarm.

13. The system of claim 9 wherein the notification device is selected from the group consisting of a speaker, a horn, an instrument, a light, a display, a vibration generator, a wireless transmitter, a wired transmitter, a voltage generator, and any combination thereof.

14. The system of claim 9 wherein the period of time is between one and five seconds.

15. The system of claim 9 wherein the period of time is three seconds.

16. The system of claim 9 wherein the period of time is programmable by a user.

17. A method for creating an alarm for the prevention of cord related injuries and deaths, the method comprising the steps of:

providing an alarm apparatus comprising a housing having a first opening on a top of the housing and a second opening on a bottom of the housing thereby creating a chamber between the first opening and the second opening, wherein the housing is disposed around a cord such that the cord is disposed within the chamber, a contact disposed within the housing adjacent the cord, wherein the contact is pushed in a first direction as a result of a force applied to the cord, a switch disposed within the housing adjacent the contact, a timer electrically connected to the switch, and a circuit electrically connecting the timer to a notification device;

counting upwards with the timer when the contact engages the switch;

creating a first signal after the timer has counted a period of time; and triggering the notification device to create an alarm upon creation of the first signal.

18. The method of claim 17 further comprising the steps of:

creating a second signal when the switch is disengaged; and triggering the notification device to terminate the alarm.

19. The method of claim 17 further comprising the step of:

resetting the timer when the switch is disengaged.

20. The method of claim 17 wherein the alarm apparatus further comprises a reset button disposed on the housing and electrically connected to the circuit, further comprising the steps of:

resetting the timer and terminating the alarm when the reset button is engaged.

* * * * *